US005524584A

United States Patent [19]

Wantanabe

[11] Patent Number: 5,524,584

[45] Date of Patent: Jun. 11, 1996

[54] CYLINDER HEAD FOR OUTBOARD MOTOR

[75] Inventor: Takahide Wantanabe, Hamamatsu, Japan

[73] Assignee: Sanshin Kogyo Kabushiki Kaisha, Hamamatsu, Japan

[21] Appl. No.: 302,204

[22] Filed: Sep. 8, 1994

[30] Foreign Application Priority Data

Sep. 8, 1993 [JP] Japan ..... 5-246090

[51] Int. Cl.[6] ..... B63H 21/26

[52] U.S. Cl. ..... 123/184.38; 123/195 HC; 123/196 W

[58] Field of Search ..... 123/195 MC, 196 W, 123/193.5, 193.3, 184.21, 184.23, 184.38, 184.39, 184.36; 440/84

[56] References Cited

U.S. PATENT DOCUMENTS

| | | | |
|---|---|---|---|
| Re. 32,620 | 3/1988 | Iwai | 123/196 W |
| 4,356,798 | 11/1982 | Sakaoka et al. | 123/184.46 |
| 4,372,258 | 2/1983 | Iwai | 123/196 W |
| 4,621,595 | 11/1986 | Suzuki | 123/41.72 |
| 4,683,846 | 8/1987 | Takayasu | 123/195 HC |
| 4,781,635 | 11/1988 | Kinouchi | 123/195 HC |
| 4,825,835 | 5/1989 | Chino et al. | 123/195 HC |
| 5,019,118 | 5/1991 | Sakamoto | 123/196 W |
| 5,181,491 | 1/1993 | Izumi et al. | 123/184.38 |

*Primary Examiner* Marguerite Macy
*Attorney, Agent, or Firm* Knobbe, Martens, Olson & Bear

[57] ABSTRACT

An outboard motor having a four-cycle internal combustion engine as a power plant. The engine is provided with a cylinder head having intake passages that extend downwardly from inlet openings in a surface of the cylinder head to outlet openings that communicate with the cylinder bores so as to reduce uneven running as might be encountered if fuel were to puddle and collect in the induction system.

16 Claims, 7 Drawing Sheets

CYLINDER HEAD FOR OUTBOARD MOTOR

BACKGROUND OF THE INVENTION

This invention relates to a cylinder head for an outboard motor and more particularly to an improved cylinder head and induction system for a four-cycle internal combustion engine as employed in an outboard motor.

As is well known, the powering internal combustion engine of an outboard motor is normally mounted in the power head so that the output or crankshaft rotates about a vertically extending axis for ease of coupling to the drive shaft. With such an arrangement, the cylinders are horizontally disposed and this normally means that the induction passages that supply the combustible mixture to the cylinders also extend generally horizontally. Horizontal disposition of the induction system has certain disadvantages, particularly when employed with outboard motors.

Outboard motors frequently run at speeds lower than idle speed, for example when trolling. Under this condition, the rate of airflow through the induction passage is quite slow and any fuel in the induction system may tend to condense and form as puddles in the intake manifold. When this occurs, the collected fuel can be delivered intermittently to the combustion chambers and cause uneven running.

Therefore, it is normally the practice with an outboard motor to dispose the induction system so that it is inclined slightly downwardly from its inlet into its discharge end.

With four-cycle practice in outboard motors, the induction system normally extends along a side of the engine and the inlet device is disposed adjacent or even beyond the crankcase relative to the cylinder block. However, with the use of downward inclination to the induction system, then the portion of the engine becomes quite high. This has a number of disadvantages. Also, since the inlet to the induction system is normally disposed to the front of the outboard motor, the necessary high front of the protective cowling dictated by the configuration of the induction system is even more objectionable.

If, however, the downward inclination is not employed, then the problems with fuel collection and irregular running will result.

It is, therefore, a principal object of this invention to provide an improved induction system for an outboard motor.

It is a further object of this invention to provide an improved induction system for a four-cycle engine as employed in an outboard motor wherein the induction system can have a downward inclination to avoid fuel collection without raising the overall height of the engine.

SUMMARY OF THE INVENTION

This invention is adapted to be embodied in a cylinder head and induction system for an outboard motor comprising a cylinder block having a cylinder bore substantially horizontally disposed. A crankshaft is rotatably journaled at one end of the cylinder block about a generally vertically extending axis-and a cylinder head is affixed to the other end of the cylinder block and closes the cylinder bore. An intake passage extends through the cylinder head from an inlet opening formed in an outer surface thereof and an outlet opening communicating with the cylinder bore. The inlet opening is disposed vertically above the outlet opening so that fuel which may condense in the intake passage will continuously flow towards the combustion chamber.

DETAILED DESCRIPTION OF THE PREFERRED EMBODIMENT OF THE INVENTION

Figure 1:
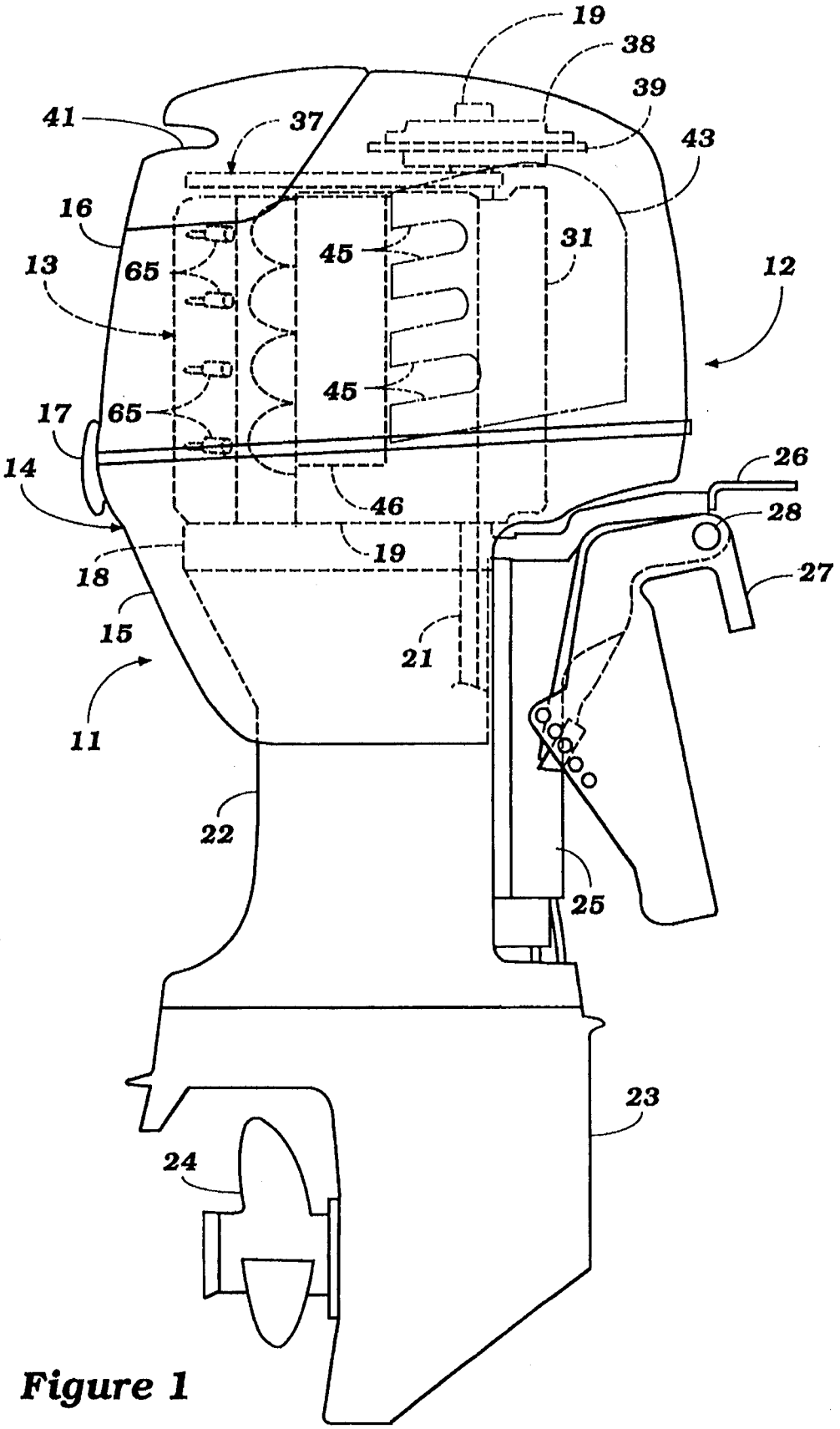
FIG. 1 is a side elevational view of an outboard motor constructed in accordance with an embodiment of the invention.

Referring now in detail to the drawings and initially to FIG. 1, an outboard motor constructed in accordance with an embodiment of the invention is identified generally by the reference numeral 11. The invention is described in conjunction with an outboard motor because it has particular utility in conjunction with engines that operate with their output shafts rotating about a vertically extending axis and their cylinder bores extending generally horizontally. Hence, the invention can be utilized in conjunction with any application of this type in addition to those embodied in outboard motors.

The outboard motor 11 includes a power head assembly, indicated generally by the reference numeral 12, that includes an internal combustion engine 13 and a protective cowling, indicated collectively by the reference numeral 14. The cowling is comprised of a lower tray section 15 and an upper main cowling portion 16 that is detachably connected to the tray 15 by means including a latch assembly 17.

The engine 13 is supported within the protective cowling 14 on a spacer plate 18 with its output or crankshaft 19 rotatably journaled about a vertically extending axis. The crankshaft 19 is drivingly connected to a drive shaft 21 that is journaled for rotation in a drive shaft housing 22 which contains the mounting plate 18 at its upper end. The drive shaft 21 continues into a lower unit 23 where it drives a propeller 24 through a forward neutral/reverse transmission (not shown) in a well known manner.

A steering bracket (not shown) is affixed to the drive shaft housing 22 in a known manner and is journaled for steering motion about a vertically extending axis within a swivel bracket 25. A tiller 26 is affixed to the upper end of the steering shaft for steering of the outboard motor 11.

The swivel bracket 25 is, in turn, pivotally connected to a clamping bracket 27 by a pivot pin 28 for tilt and trim movement of the outboard motor 11 in a well known manner. The clamping bracket 27 contains a suitable device for detachable connection to the transom of an associated watercraft (not shown).

The construction of the outboard motor 11 as thus far described may be considered to be conventional and since it, per se, forms no part of the invention, further description of it is not believed to be necessary and where components are not described, they may be considered to be conventional.

Referring now additionally to FIGS. 2–5, the engine 13 will be described in more detail. The engine 13, in the illustrated embodiment, is of the four-cylinder in-line type operating on a four-cycle principal. It is to be understood, however, that the invention may be utilized with engines having other cylinder numbers and other configurations and that some facets of the invention may also be employed with two-cycle engines. However, since the system deals primarily with the induction system and that formed in the cylinder head, particular utility is present in conjunction with four-cycle engines.

The engine 13 includes a cylinder block 29 having four cylinder bores that have their axes disposed in a horizontal direction and which are vertically spaced one above the other. These cylinders reciprocally support pistons that are connected by connecting rods (not shown) to drive the crankshaft 19. As have been previously noted, the crankshaft 19 rotates about a vertically extending axis. This crankshaft is journaled within a crankcase chamber formed by the skirt of the cylinder block 29 and a crankcase member 31 which is affixed to one end of the cylinder block 29 in any known manner. It should be noted that the crankcase member 31 is formed at the front of the power head 12.

A cylinder head, indicated by the reference numeral 32, is affixed to the opposite end of the cylinder block 29 and is formed with combustion chamber recesses 33, each of which cooperates with a respective one of the cylinder bores and the pistons formed therein for forming the combustion chambers of the engine. In the illustrated embodiment and as will become more apparent as the description proceeds, the engine 13 is of the overhead cam, two-valve per cylinder type. In order to operate the intake and exhaust valves therefor, a cam shaft 34 is rotatably journaled within the cylinder head 32 in a known manner and engages rocker arms shown in phantom at FIG. 4 and identified by the reference numeral 35 for operating the valves associated with each cylinder in a well known manner. The valve mechanism as thus far described is contained within a valve chamber that is closed by a cam cover 36 that is affixed to a cylinder block 32 in any well known manner.

Figure 2:
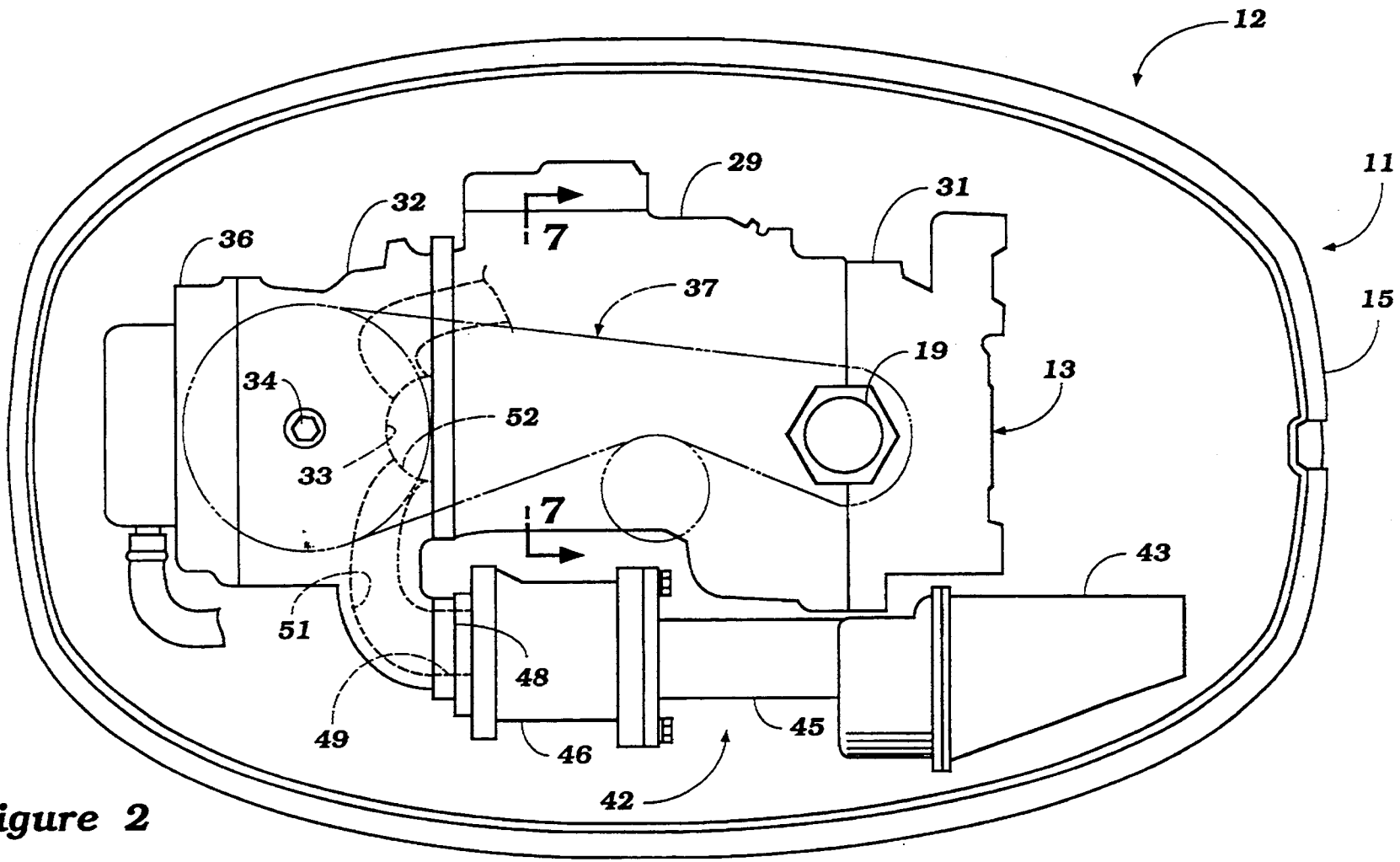
FIG. 2 is a top plane view of the power head of the outboard motor on an enlarged scale and with the main cowling portion removed so as to more clearly show the construction of the engine.
Figure 3:
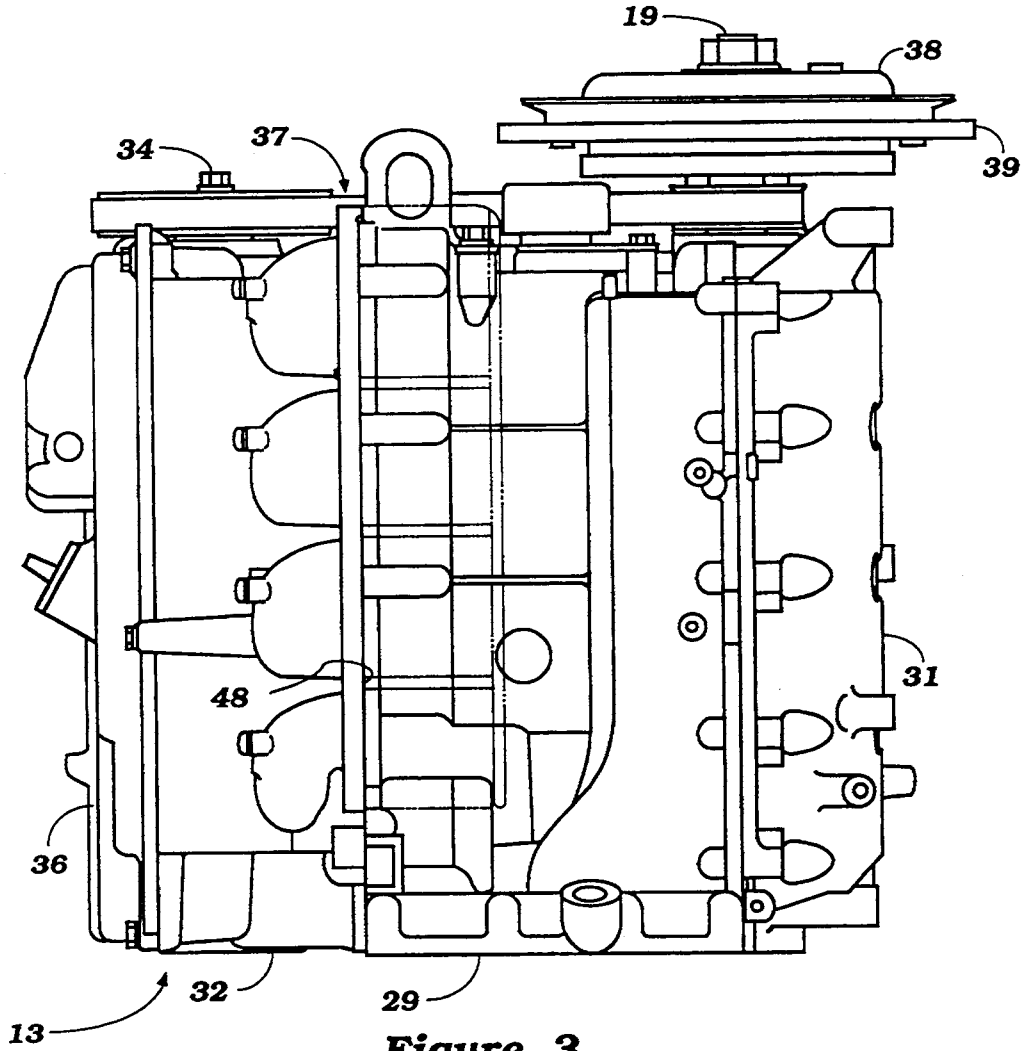
FIG. 3 is a side elevational view of the engine.
Figure 4:
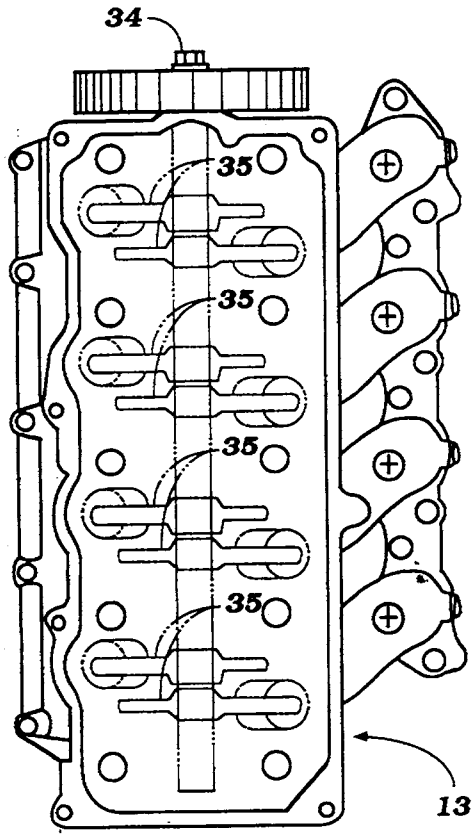
FIG. 4 is a top plane view of the cylinder head with the cam cover removed and the valves and valve actuating mechanism shown in phantom.
Figure 5:
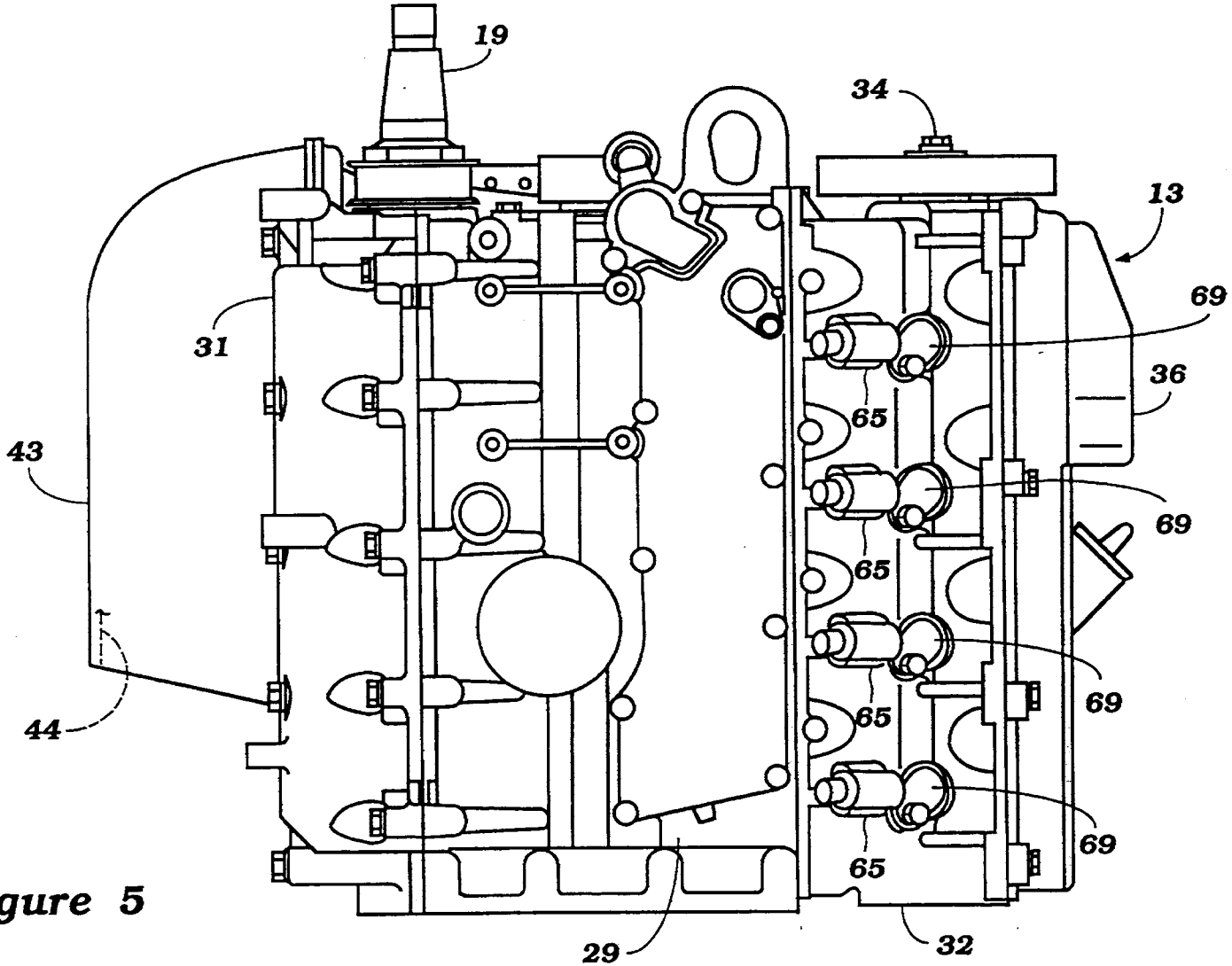
FIG. 5 is a side elevational view, in part similar to FIG. 3 but looking in the opposite direction.

The cam shaft 34 is driven from the crankshaft 19 at one-half crankshaft speed by a suitable cam driving arrangement and as illustrated in FIGS. 1 and 2 this may constitute a timing belt drive, indicated generally at 37. In addition, a flywheel magneto assembly 38 is mounted on the crankshaft 19 above the sprocket that drives the drive belt assembly 37. This flywheel magneto assembly 38 also includes a starter gear 39 that is adapted to be engaged by an electric starter (not shown) for starting of the engine 13 electrically in a well known manner.

Atmospheric air is admitted to the interior of the protective cowling 14 by means of a rearwardly facing air inlet 41 formed in a part of the main cowling member 16. This atmospheric air is introduced to supply air for the combustion process of the engine 13 and is delivered to the cylinder head assembly 32 by means of an induction system, indicated generally by the reference numeral 42 and which is shown in most detail in FIGS. 1, 2 and 5.

This induction system includes an air inlet device 43 that is mounted adjacent the crankcase member 31 and which extends in part forwardly of it in the power head 12. The air inlet device 43 has a downwardly facing air inlet opening 44 through which air is drawn. This air is then delivered to a plurality of intake pipes 45, which extend slightly in a downward direction from the air inlet device 43 to a plurality of charge formers such as carburetors 46.

The carburetors 46, in turn, supply the fuel-air mixture to the cylinder head assembly 32 in a manner which will now be described by particular reference to FIGS. 6 and 8, although the portions of the cylinder head induction system also appear in other of the figures. As may be seen in FIG. 6, the cylinder head 32 has a lower surface 47 that is adapted to be maintained in sealing relationship with the cylinder block 29. Integral with the cylinder head is a spaced apart flange portion 48 to which the carburetors 46 are adapted to be affixed and which has a plurality of intake passage inlet openings 49 that face toward the cylinder block 29 but are spaced transversely outwardly from it.

The inlet openings 49 are formed at the inlet ends of cylinder head intake passages 51, which are formed integrally in the cylinder head 32 and which extend in a generally U-shaped fashion from the downwardly facing inlet openings 49 to valve seats 52 formed in the combustion chamber recesses 33, as afore referred to. As may be seen from FIG. 6, the valve seats 52 which form the outlet openings of the intake passages 51 are disposed substantially below the inlet openings 49. Hence, any fuel which may condense in the intake passages 51 will flow by gravity down to the valve seats 52 and into the combustion chamber recesses 33 each time the intake valve seats 52 are opened, as will now be described.

Each intake valve seat 52 is valved by means of a poppet-type intake valve, indicated generally by the reference numeral 53 and which has a head portion 54 that cooperates with the respective valve seat 52 for controlling the flow through it. The head portions 54 are formed at one end of stem portions 55 that are supported for reciprocation within valve guides 56 pressed or cast into the cylinder head 32.

A keeper retainer assembly 57 is affixed to the upper ends of the valve stem 55 and is engaged by a coil compression spring 58. The other end of the spring 58 engages a machined surface 59 of the cylinder head for urging the intake valves 53 to their closed position.

As has been previously noted, the intake valves 53 are operated by rocker arms 35, and these rocker arms carry adjusting screws 61 at their outer ends which engage the tips of the valve stems 55. The rocker arms 35 are further provided with follower surfaces 62 that engage the lobes 63 of the camshaft 34 for opening the valves 53 in a well-known manner.

Figure 6:
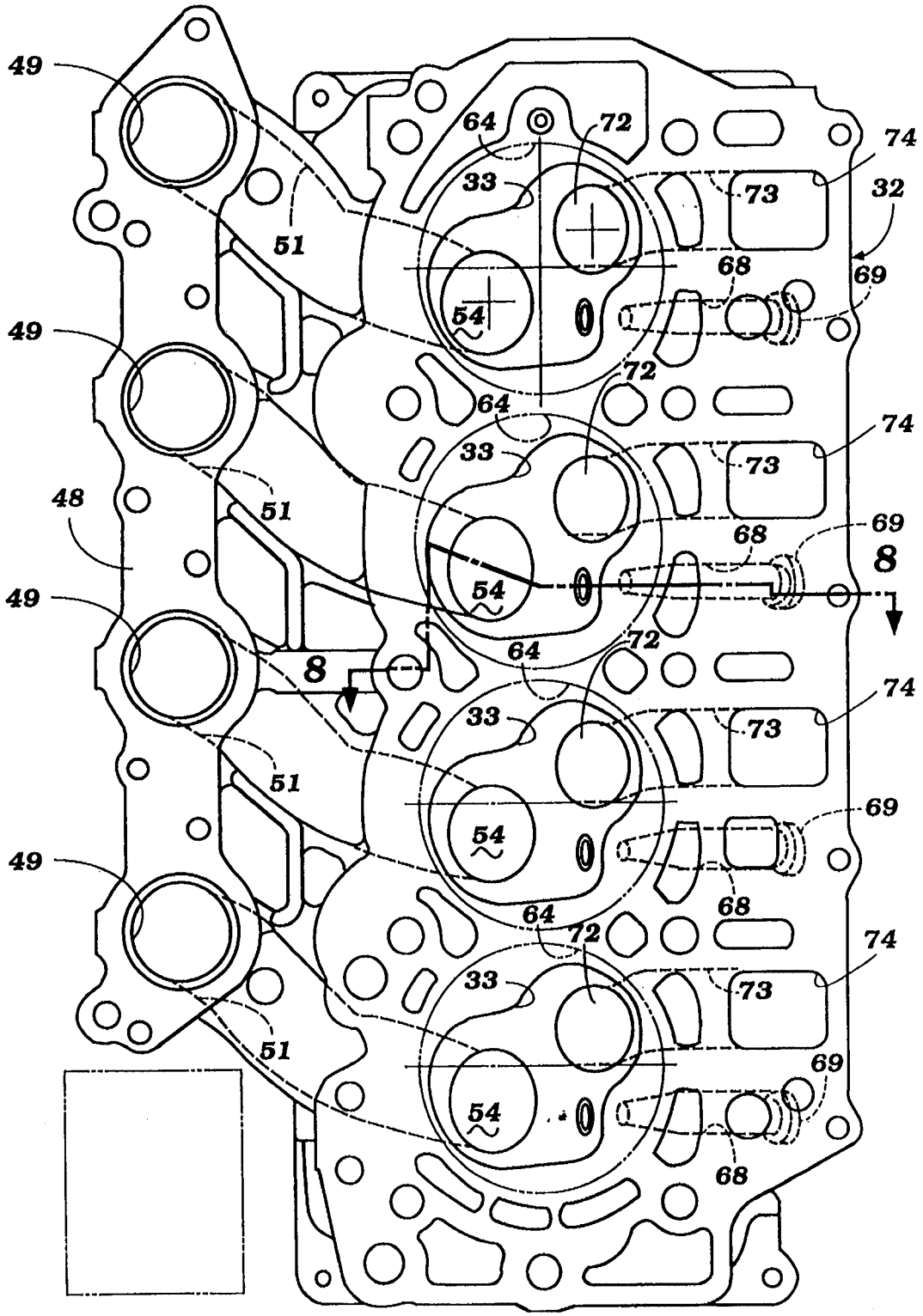
FIG. 6 is a bottom plane view of the cylinder head.

As may be seen in FIG. 6, the intake valve seats 52 and the heads of the intake valves 54, when in their closed position, lie in the lower left-hand quadrant defined by a pair of intersecting planes containing the axes of the cylinder bores, which cylinder bores are shown by the phantom lines 64 in this figure. Thus, the intake valve seats 52 are formed relatively low in the combustion chambers, and this further permits the downward inclination of the intake passages that avoids the problems of fuel puddling and uneven running at low speeds.

Spark plugs 65 are mounted in spark plug recesses 66 on the opposite quadrant of these planes and are fired by a suitable ignition system. These spark plugs 65 are mounted on the exhaust side of the engine.

Figure 8:
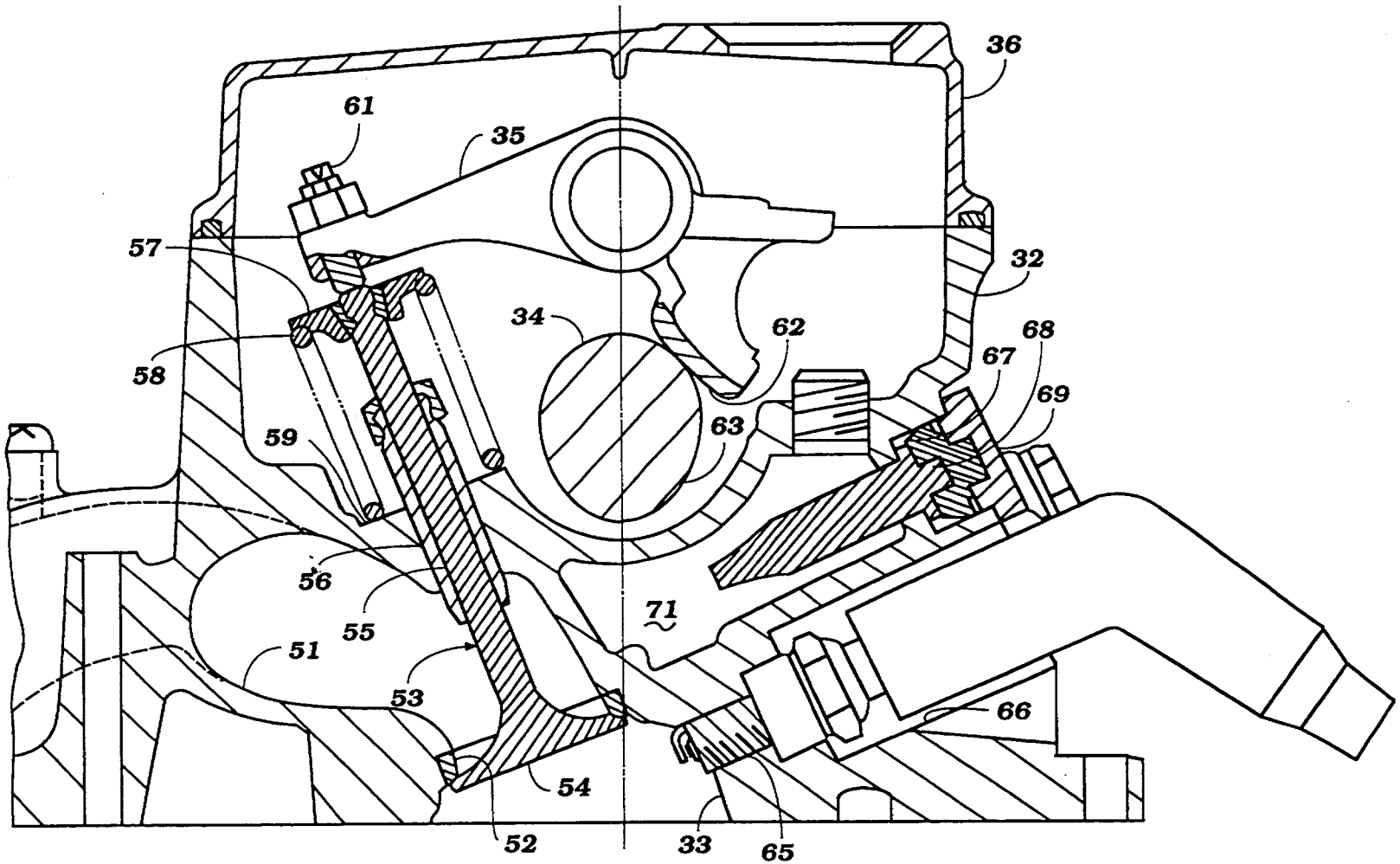
FIG. 8 is an enlarged cross-sectional view taken along the line 8—8 of FIG. 6.

As shown in FIG. 8, there are provided a plurality of openings 67 in the cylinder head 32 above each spark plug well 66 and into which a sacrificial anode 68 is inserted and held in place by a retainer assembly 69. As a result of this construction, the sacrificial anodes 69 are readily accessible for servicing and replacement, as well as inspection. The sacrificial anodes 68 are inserted into a cylinder head cooling jacket 71 which receives liquid coolant circulated through the engine in a well-known manner.

Figure 7:
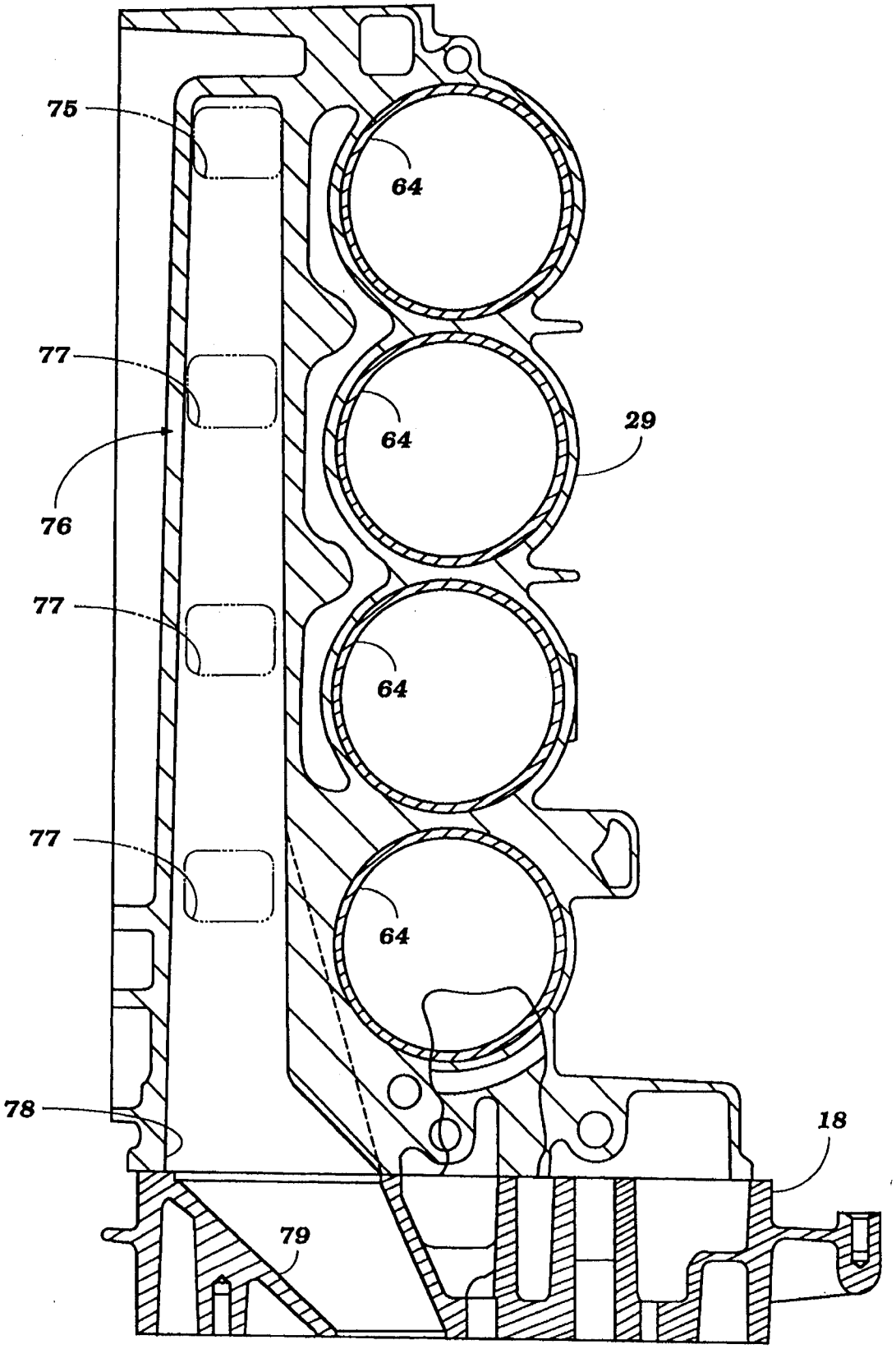
FIG. 7 is a cross-sectional view taken along the line 7—7 of FIG. 2.

Referring now to FIGS. 6 and 7, the system for exhausting exhaust gases from the combustion chamber recesses 33 will be described. This includes valve seats that are controlled by poppet-type exhaust valves 72 which are mounted in the cylinder head 32 and are operated by a mechanism similar to that already described in conjunction with the intake valves 53. These valve seats are formed at the inlet ends of exhaust passages 73 which extend through the cylinder head 32 also in a U-shaped pattern, as seen in a view similar to FIG. 8.

The exhaust passages 73 terminate in exhaust gas discharge openings 74 that are formed in the cylinder head sealing surface 47 and which cooperate with corresponding inlet openings 75 of an exhaust manifold, indicated generally by the reference numeral 76, and which is formed integrally in the cylinder block 29, as clearly seen in FIG. 7. This exhaust manifold 76 extends vertically downwardly through the cylinder block, as is typical with outboard motor practice, and terminates in a discharge end 78. The discharge end 78 cooperates with an exhaust discharge passage 79 formed in the spacer plate 18. From there, the exhaust gases are discharged to the atmosphere through an underwater exhaust gas discharge of any known type which is contained within the drive shaft housing 22 and lower unit 23. This may include a through-the-hub propeller discharge.

It should be readily apparent from the foregoing description that the described cylinder head and induction system are very effective in providing a system wherein the intake charge, once formed with fuel and air, will flow in a generally downward direction and enter the combustion chamber recesses 33. Because of this downward inclination and the fact that it is formed primarily within the cylinder head 32, the overall engine 13 can be kept quite compact, and yet smooth running and lack Of irregular running due to fuel puddling can be achieved. Of course, the foregoing description is that of a preferred embodiment of the invention, and various changes and modifications may be made without departing from the spirit and scope of the invention, as defined by the appended claims.

I claim:

1. A cylinder head and induction system for an outboard motor comprising a cylinder block having at least a pair of cylinder bores substantially horizontally disposed with their axes lying in a common vertical plane, a crankshaft rotatably journaled at one end of said cylinder block about a generally vertically extending axis, a cylinder head affixed to the other end of said cylinder block and closing said cylinder bores, a pair of intake passages extending downwardly through said cylinder head from respective inlet openings formed in an outer surface thereof on one side of said vertical plane to respective outlet openings communicating with said cylinder bores, said inlet openings being disposed vertically above said outlet openings.

2. A cylinder head and induction system as in claim 1, wherein the inlet openings are formed in a surface of the cylinder head that extends substantially in coplanar relation with the surface of the cylinder head engaged with the cylinder block.

3. A cylinder head and induction system as in claim 1, wherein the intake passages are served by an induction system extending along the cylinder block on one side of the vertical plane.

4. A cylinder head and induction system as in claim 3, wherein the induction system has an inlet adjacent the crankshaft.

5. A cylinder head and induction system as in claim 4, wherein the induction system includes a plurality of downwardly inclined intake pipes terminating at respective of the cylinder head inlet openings.

6. A cylinder head and induction system as in claim 5, wherein the inlet openings are formed in a surface of the cylinder head that extends substantially in coplanar relation with the surface of the cylinder head engaged with the cylinder block.

7. A cylinder head and induction system as in claim 1, further including exhaust passages formed in the cylinder head on the side of the vertical plane opposite the intake passages and having inlet openings communicating with the cylinder bores and outlet openings.

8. A cylinder head and induction system as in claim 7, wherein the inlet openings of the exhaust passages are disposed vertically beneath the inlet openings of the intake passages.

9. A cylinder head and induction system as in claim 8, wherein the outlet openings of the intake passages are disposed vertically below the inlet openings of the exhaust passages.

10. A cylinder head and induction system as in claim 9, wherein the intake passages are served by an induction system extending along the cylinder block oil one side of the vertical plane.

11. A cylinder head and induction system as in claim 10, wherein the induction system has an inlet adjacent the crankshaft.

12. A cylinder head and induction system as in claim 11, wherein the induction system includes a plurality of downwardly inclined intake pipes terminating at respective of the cylinder head inlet opening.

13. A cylinder head and induction system as in claim 9, wherein the inlet openings are formed in a surface of the cylinder head that extends substantially in coplanar relation with the surface of the cylinder head engaged with the cylinder block.

14. A cylinder head and induction system as in claim 13, wherein the intake passages are served by an induction system extending along the cylinder head on one side of the vertical plane.

15. A cylinder head and induction system as in claim 14, wherein the induction system has an inlet adjacent the crankshaft.

16. A cylinder head and induction system as in claim 15, wherein the induction system includes a plurality of downwardly inclined intake pipes terminating at respective of the cylinder head inlet openings.

* * * * *